US011039966B1

(12) United States Patent
Schultz

(10) Patent No.: US 11,039,966 B1
(45) Date of Patent: Jun. 22, 2021

(54) MOBILITY VEHICLE HANDLING SYSTEM

(71) Applicant: Robert D. Schultz, Sanger, CA (US)

(72) Inventor: Robert D. Schultz, Sanger, CA (US)

( * ) Notice: Subject to any disclaimer, the term of this patent is extended or adjusted under 35 U.S.C. 154(b) by 0 days.

(21) Appl. No.: 16/937,686

(22) Filed: Jul. 24, 2020

(51) Int. Cl.

| | |
|---|---|
| ***A61G 3/00*** | (2006.01) |
| ***A61G 3/06*** | (2006.01) |
| ***B66C 23/44*** | (2006.01) |
| *B66C 1/34* | (2006.01) |

(52) U.S. Cl.
CPC ..... *A61G 3/062* (2013.01); *B66C 23/44* (2013.01); *B66C 1/34* (2013.01); *B66D 2700/026* (2013.01)

(58) Field of Classification Search
CPC ..... B66C 1/07; B66C 23/04; B66C 23/18; B66C 23/36; B66C 23/365; B66C 23/40; B66C 23/42; B66C 23/44; B60P 1/54; B60P 1/5471; A61G 3/062
See application file for complete search history.

(56) References Cited

U.S. PATENT DOCUMENTS 4,010,859 A * 3/1977 Ronian ..... A61G 3/06 414/546
4,039,096 A * 8/1977 McAllister ..... B60R 9/0426 414/462
4,067,471 A 1/1978 Roatcap
4,881,864 A * 11/1989 Amato ..... B60R 9/06 414/543
4,926,973 A * 5/1990 Smith ..... A61G 3/063 187/213
4,984,955 A * 1/1991 McCullough ..... B66B 9/00 187/243
5,090,580 A * 2/1992 Nelson ..... B66C 23/44 212/180
5,154,569 A * 10/1992 Eryou ..... A61G 3/063 14/71.3
5,205,700 A * 4/1993 Lin ..... A61G 3/0209 414/540
5,810,547 A * 9/1998 Bruno ..... B66C 23/44 414/543
5,853,282 A * 12/1998 Bechler ..... B60P 1/548 414/543
6,007,289 A * 12/1999 Kruse ..... A61G 3/0209 414/462
6,105,728 A * 8/2000 Combs, Jr. ..... B66B 9/00 182/145
6,138,991 A * 10/2000 Myers, Jr. ..... B66C 23/44 212/180

(Continued)

OTHER PUBLICATIONS

Lifter. Product Listing [online]. Bruno [retrieved on Jun. 13, 2019]. Retrieved from the Internet: <URL: https://www.bruno.com/scooter-lifts/lifter>.

(Continued)

*Primary Examiner* — Emmanuel M Marcelo
(74) *Attorney, Agent, or Firm* — Cramer Patent & Design, PLLC; Aaron R. Cramer

(57) ABSTRACT

A mobility handling vehicle mechanism includes a tubular frame having a battery and winch secured within the frame. A telescoping lift arm is movably secured to the outside top surface of the frame. A hook and cable are secured to the end of the telescoping lift arm and winch. When secured within a transporting vehicle, the device enables a user to utilize the winch to lift a mobility handling vehicle into the transporting vehicle.

20 Claims, 6 Drawing Sheets

(56) References Cited

U.S. PATENT DOCUMENTS

| | | | | |
|---|---|---|---|---|
| 6,547,507 | B1 | 4/2003 | Gest et al. | |
| 7,182,319 | B2 | 2/2007 | Panzarella et al. | |
| 7,318,698 | B1 | 1/2008 | Gipson | |
| 7,396,202 | B1 | 7/2008 | Panzarella et al. | |
| 7,717,663 | B1 * | 5/2010 | Stowers | B60P 1/548 414/550 |
| 8,057,152 | B1 * | 11/2011 | White | A61G 3/067 414/546 |
| 8,286,754 | B2 * | 10/2012 | Cohn | B66B 9/0807 187/267 |
| 9,603,759 | B2 | 3/2017 | Kitchin et al. | |
| 9,937,088 | B2 * | 4/2018 | Guertler | B60R 9/0426 |
| 2005/0189798 | A1 * | 9/2005 | Strong | B60B 33/0039 297/183.7 |
| 2005/0214104 | A1 * | 9/2005 | Strong | A61G 5/104 414/546 |
| 2009/0144895 | A1 * | 6/2009 | Bostelman | A61G 7/1098 5/87.1 |
| 2010/0247277 | A1 * | 9/2010 | DiGiovanni | A61G 3/06 414/462 |
| 2018/0086601 | A1 * | 3/2018 | Okonski | B66B 9/08 |

OTHER PUBLICATIONS

Harmar AL055 Economical Inside Micro Scooter Lift. Product Listing [online]. © 2013 Progress Mobility [retrieved on Jun. 13, 2019]. Retrieved from the Internet:<URL: https://www.progressmobility.com/harmar-al055-economical-inside-micro-scooter-lift.html>.

Bestcare BestLift Car Transfer Lift. Product Listing [online]. Med+Mart [retrieved on Jun. 13, 2019]. Retrieved from the Internet:<URL: https://medmartonline.com/bestcare-bestlift-car-transfer-lift >.

* cited by examiner

MOBILITY VEHICLE HANDLING SYSTEM

RELATED APPLICATIONS

None.

FIELD OF THE INVENTION

The presently disclosed subject matter is directed to a handling system and more specifically to a handling system for a mobility vehicle.

BACKGROUND OF THE INVENTION

People with physical disabilities, such as the elderly and handicapped, know all too well of some of the difficulties that they encounter while performing tasks that most of us take for granted. What comes easily to those that are not physically challenged, such as climbing stairs or tying shoes, requires extreme physical exertion or, worse yet, is altogether impossible to accomplish without assistance.

Mobility scooters have provided relief in this regard, and are much more maneuverable than wheelchairs, especially for those user's with diminished strength. While they are ideal in and around the user's residence, many wish to travel with them which means transporting them in a vehicle. Unfortunately, they are very heavy and even those in prime physical condition experience difficulty in trying to lift them in and out of a vehicle. Accordingly, there exists a need for a means by which mobility scooters can be easily transferred in and out of an appropriate vehicle. The development of the mobility vehicle handling mechanism fulfills this need.

SUMMARY OF THE INVENTION

The principles of the present invention provide for a mobility scooter transfer device which comprises a frame that has a plurality of base members, a plurality of vertical members, a plurality of top members, a plurality of top reinforcement members, a plurality of side support members, and a plurality of side reinforcement members. The base members form a stable structure when connected to the vertical members, which in turn support the side support members, the top members, the front reinforcement members and a rear top reinforcement member. The rear side reinforcement member and the intermediate top reinforcement member is supported by the top members. The mobility scooter transfer device also comprises a winch mechanism which is mounted on an equipment platform and attached to the frame.

The winch mechanism includes a flexible lift cable which is routed from a reel through a spring pulley and onto a proximal pulley, a lift arm support bracket which is mounted in a perpendicular manner on top of central aligned positions of each of the top reinforcement members, a retractable lift arm which is mounted atop the lift arm support bracket using at least one "U"-shaped clamp, a pulley cover which provides a protective cover to the spring pulley and the distal pulley and a first hinged section which is connected to the base via a first continuous hinge. The first hinged section serves as a storage platform for the mobility scooter.

The mobility scooter transfer device also comprises a pair of guides which are located on opposing perimeter edges of the first hinged section adjacent the base and extend away perpendicularly. The mobility scooter transfer device also comprises a second hinged section which is connected to the first hinged section by a second continuous hinge, an equipment platform which supports the side support members and the side reinforcement members, an in-line fuse which provides for electrical protection and a charge controller which is mounted to the equipment platform. The charge controller may be used to charge the rechargeable battery. The mobility scooter transfer device also comprises an incoming power cable which brings power to the charge controller from the electrical system of the motor vehicle and an equipment mounting platform which provides for storage of the rechargeable battery, the winch mechanism, the charge controller, and the in-line fuse. The base, the first hinged section, and the second hinged section serve to house a mobility scooter. The rechargeable battery and the winch mechanism are affixed to the equipment platform.

Each of the rear top reinforcement members serve as a connection point for the spring component of the spring pulley, through which the spring pulley is routed. The frame may have a trapezoidal prism shape. The flexible lift cable may be routed through the hollow interiors of the sequential tubular elements of the retractable lift arm whereupon the flexible lift cable may emerge at a distal end of each of the sequential tubular elements and is routed through a distal pulley. The distal end of the flexible lift cable may terminate at a lift hook. The retractable lift arm may include a plurality of sequential tubular elements which may slide inside of the neighboring sequential tubular elements allowing the retractable lift arm to retract along an extension/retraction travel path. The retractable lift arm may be segmented into a plurality of sections and may be locked in an extended position with a plurality of mechanical fixators.

The retractable lift arm may be segmented into a plurality of sections and may be locked in an extended position with a plurality of electrical fixators. The pulley cover may be removably attached to the individual pulley. The pulley cover may surround the individual pulley and may be curved to reduce snagging with the motor vehicle. The pair of guides may be "L"-shaped and help guide the mobility scooter during ingress and egress on the base. The equipment platform may hold a rechargeable battery and the winch mechanism that includes the reel, a motor, and a control switch. The pulley cover may be curved to reduce incidental contact with the motor vehicle. The mobility scooter transfer device may lift and lower the mobility scooter in and out of a cargo area of a motor vehicle.

The motor vehicle may be a vehicle selected from the group consisting of a sport utility vehicle, a minivan, a pickup truck, a van, or a station wagon and may be provided with a rear cargo area in which the mobility scooter transfer device may be installed. The mobility scooter transfer device may be made of metal such as aluminum and may be forty-two inches wide, forty-two inches deep and thirty-six inches tall.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | mobility scooter transfer device |
| 15 | frame |
| 20 | base member |
| 25 | vertical member |
| 30 | top member |
| 35 | top reinforcement member |
| 38 | side reinforcement member |
| 40 | lift arm support bracket |
| 45 | retractable lift arm |
| 50 | "U"-shaped clamp |
| 55 | sequential tubular element |
| 60 | extension/retraction travel path "er" |
| 70 | flexible lift cable |
| 75 | reel |

DESCRIPTION OF THE PREFERRED EMBODIMENTS

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Figure 1:
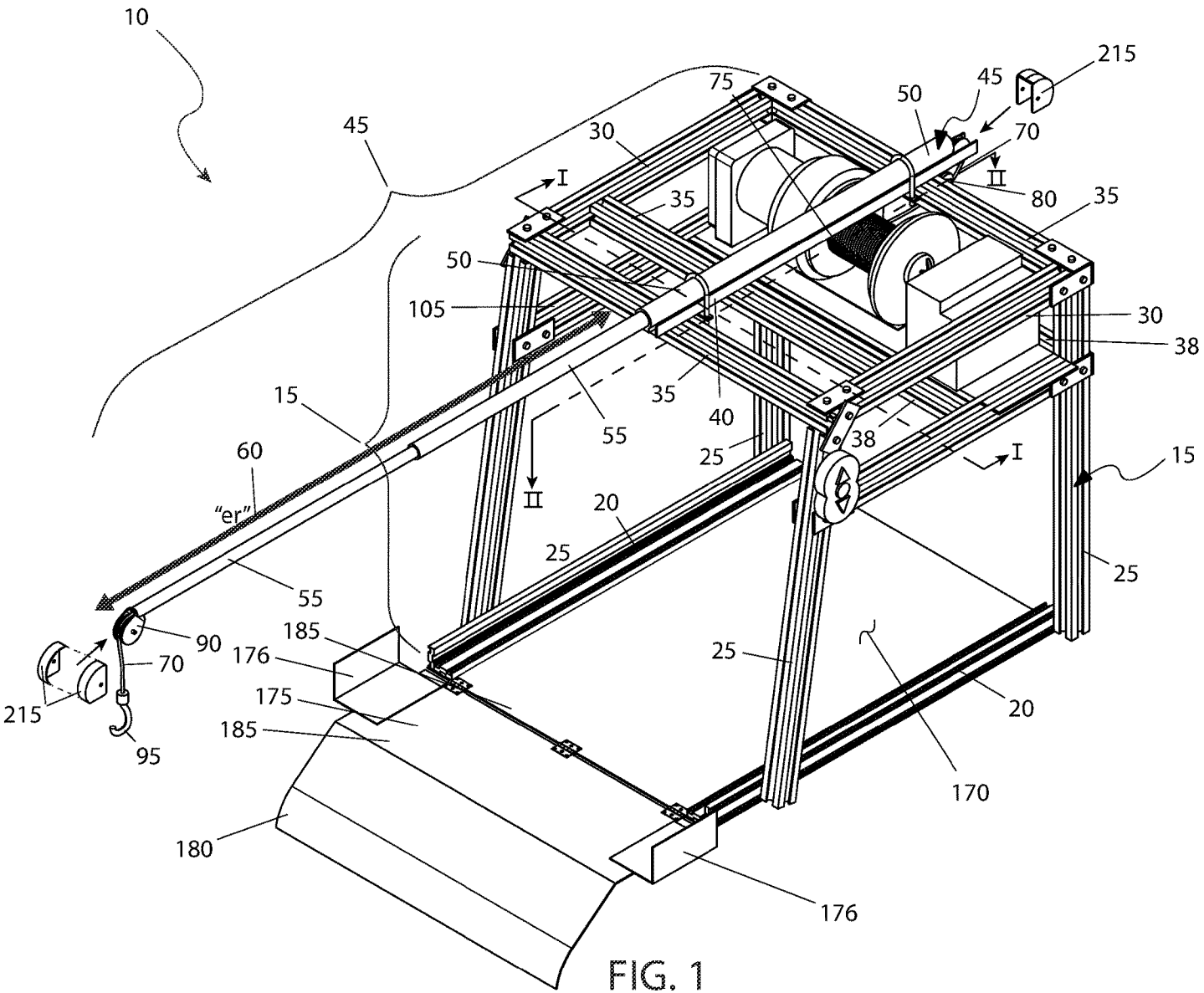
FIG. 1 is a perspective view of the mobility scooter transfer device, according to the preferred embodiment of the present invention.

Referring now to FIG. 1, a perspective view of the mobility scooter transfer device 10, according to the preferred embodiment of the present invention is disclosed. The mobility scooter transfer device 10 (herein also described as the "device") 10, is designed to lift and subsequently lower a mobility scooter 160 in an out of the cargo area 155 of a motor vehicle 150 such as a sport utility vehicle (SUV), minivan, pickup truck, van, station wagon, or the like. The device 10 includes a frame 15 in the general shape of a trapezoidal prism. The frame 15 further includes base members 20, vertical members 25, top members 30, top reinforcement members 35, side support members 105, and side reinforcement members 38. A winch mechanism 115 is mounted on an equipment platform 100 attached to the frame 15.

According to an exemplary embodiment of the device 10, the frame 15 is constructed where the rear vertical members 25 are attached to the rear terminal ends of the base members 20. The front vertical members 25 are attached at outer sides of an intermediate position long the base members 20 and are angled rearwardly as they extend upwardly. Opposing distal ends of a front top reinforcement member 35 are attached between upper terminal ends of the front vertical members 25. Opposing distal ends of a rear top reinforcement member 35 are attached between upper terminal ends of the rear vertical members 25. Opposing distal ends of a left top member 30 are attached between left terminal ends of the front and rear top reinforcement members 35. Opposing distal ends of a right top member 30 are attached between right terminal ends of the front and rear top reinforcement members 35. Opposing distal ends of an intermediate top reinforcement member 35 are attached between intermediate positions of inner sides of the left and right top members 30. Opposing distal ends of a left side support member 105 are attached between intermediate facing sides of the front left and rear left top reinforcement members 35 and disposed parallel with the left top member 30. Opposing distal ends of a right side support member 105 are attached between intermediate facing sides of the front right and rear right vertical members 25 and disposed parallel with the right top member 30. Opposing distal ends of a front side reinforcement member 38 are attached between intermediate positions of inner sides of the left and right side support members 105. Opposing distal ends of a rear side reinforcement member 38 are attached between intermediate positions of inner sides of the left and right side rear vertical members 25.

A lift arm support bracket 40 is mounted in a perpendicular manner on top of central aligned positions of each of the top reinforcement members 35. A retractable lift arm 45 is mounted atop the lift arm support bracket 40 using at least one (1) "U"-shaped clamp 50. The retractable lift arm 45 includes multiple sequential tubular elements 55 which slide inside of the neighboring sequential tubular elements 55 allowing it to retract along an extension/retraction travel path "er" 60. The retractable lift arm 45 is segmented into at least two (2) sections and is locked in an extended position with mechanical or electrical fixators. Those skilled in the art will appreciated that the use of any specific type of fixators is not intended to be a limiting factor of the present invention.

The winch mechanism 115 includes a flexible lift cable 70 routed from a reel 75 through a spring pulley 80 and onto a proximal pulley 85 (not visible in this figure due to illustrative limitations). At this location, the flexible lift cable 70 is then routed through the hollow interiors of the sequential tubular elements 55 of the retractable lift arm 45 whereupon it emerges at the distal end and is routed through a distal pulley 90. The distal end of the flexible lift cable 70 then terminates at a lift hook 95. The overall size of the device 10 may vary per specific need as dictated by the size of the vehicle, mobility scooter or the like. A pulley cover 215 is provided to provide a protective cover to the spring pulley 80 and distal pulley 90. The pulley cover 215 can be removably attached to or capable of surrounding the individual pulley 80, 90. The profile of the pulley cover 215 is curved to reduce the instances of snagging or incidental contact with features of the motor vehicle 150.

The lower section of the device 10 is provided with a flat base 170. A first hinged section 175 is connected to the base 170 via a continuous hinge 185. A pair of guides 176 are located on opposing perimeter edges of the first hinged section 175, adjacent the base 170, and extend away perpendicularly therefrom. The guides 176 are "L"-shaped and help guide the mobility scooter 160 when during ingress and egress on the base 170. Likewise, a second hinged section 180 is connected to the first hinged section 175 by another continuous hinge 185. The base 170, the first hinged section 175, and the second hinged section 180 serve to house a mobility scooter 160 (not shown in this illustration for purposes of clarity) and whose functionality will be described in greater detail herein below. A typical overall size of the device 10 with the retractable lift arm 45 in a retracted position would be approximately forty-two inches (42 in.) wide, forty-two inches (42 in.) deep and thirty-six inches (36 in.) tall. However, as noted, any specific dimension associated with the device 10 is not intended to be a limiting factor of the present invention. The material of construction used with the majority of the device 10 is envisioned to be metal such as steel or aluminum for strength.

Figure 2:
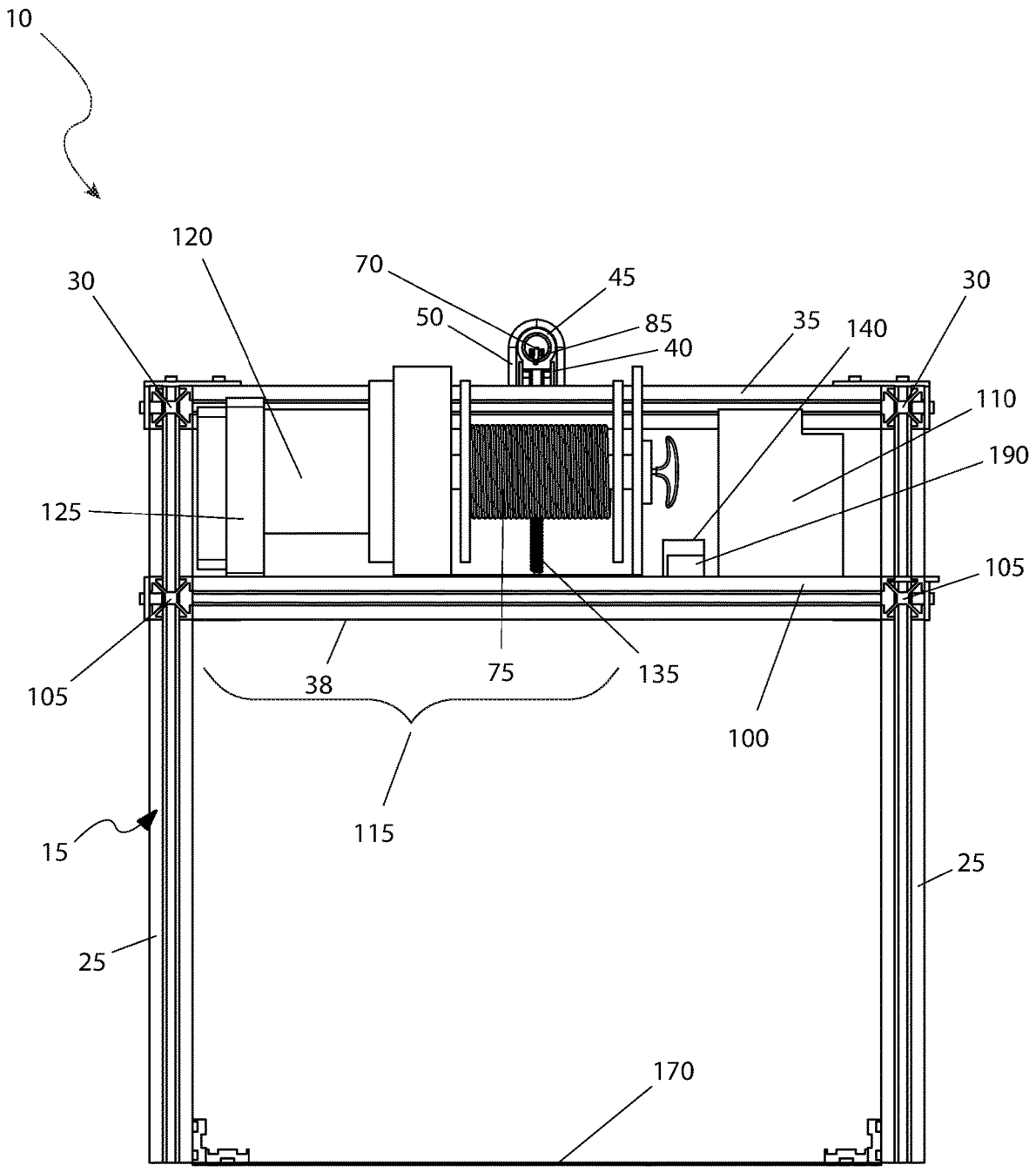
FIG. 2 is a sectional view of the mobility scooter transfer device, as seen along a line I-I, as shown in FIG. 1, according to the preferred embodiment of the present invention.

Referring now to FIG. 2, a sectional view of the device 10, as seen along a line I-I, as shown in FIG. 1, according to the preferred embodiment of the present invention is depicted. The overall frame 15 (as shown in FIG. 1) is comprised of the base members 20, the vertical members 25, the top members 30, the top reinforcement members 35, the side support members 105, and the side reinforcement members 38 as shown. An equipment platform 100 is supported the side support members 105 and the side reinforcement members 38. The equipment platform 100 holds a rechargeable battery 110 and the winch mechanism 115 including the reel 75, a motor 120, and a control switch 125. The winch mechanism 115 is envisioned as a standard device that operates on 12 VDC and is found on bumpers of trucks utilized in an off-road environment. An in-line fuse 190 is provided for electrical protection. Further description of the winch mechanism 115 and the rechargeable battery 110 will be provided herein below. The flexible lift cable 70 is routed through the spring pulley 80, the proximal pulley 85, and into the retractable lift arm 45 as aforementioned described. The flat base 170 serves as a storage platform for the mobility scooter 160 (not shown in this illustration for purposes of clarity).

Figure 3:
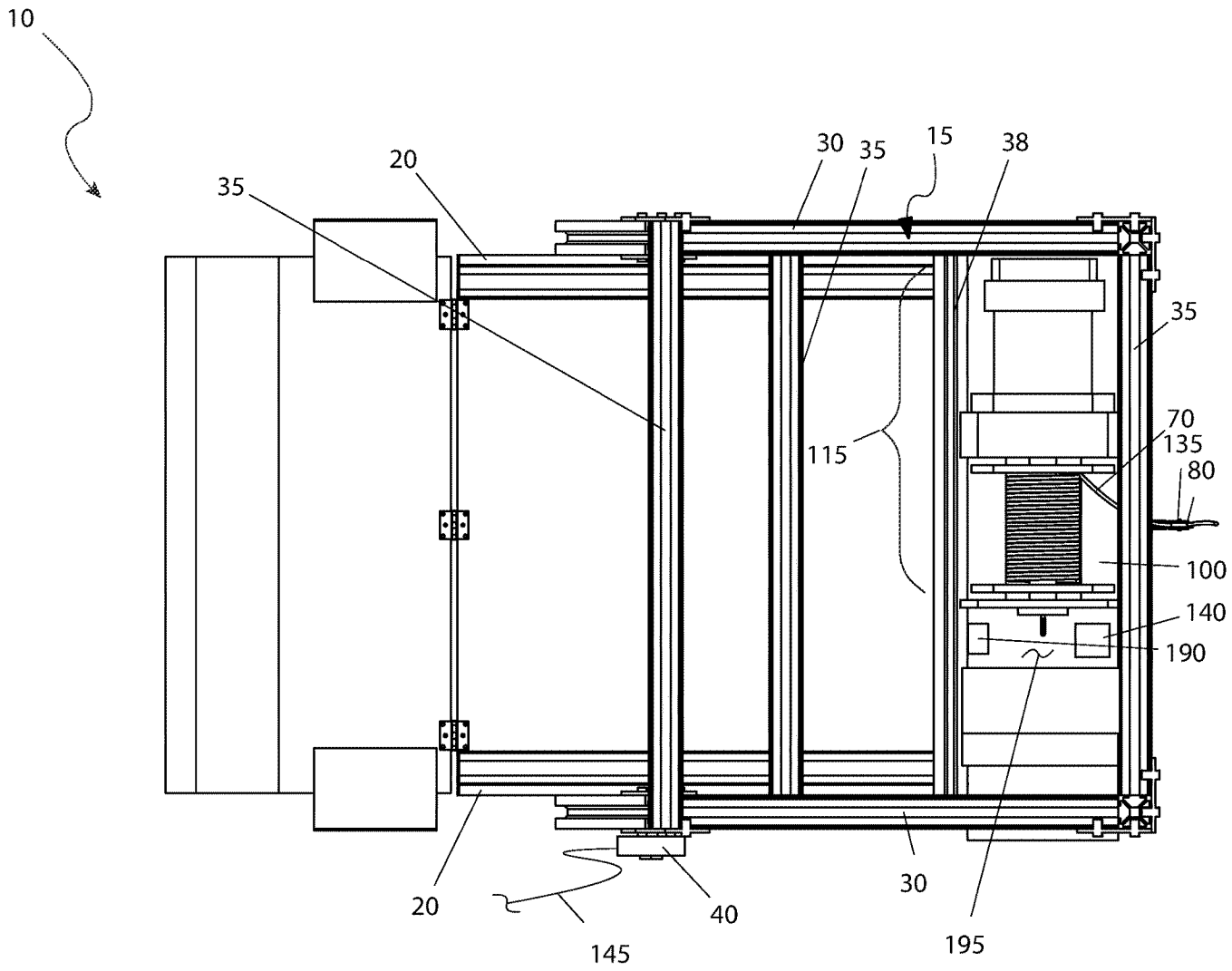
FIG. 3 is a sectional view of the mobility scooter transfer device, as seen along a line II-II, as shown in FIG. 1, according to the preferred embodiment of the present invention.

Referring next to FIG. 3, a sectional view of the device 10, as seen along a line II-II, as shown in FIG. 1, according to the preferred embodiment of the present invention is shown. The base members 20 are visible and form a stable structure when connected to the vertical members 25, which support the side support members 105, the top members 30, the front and rear top reinforcement members 38, and the rear side reinforcement member 35. The intermediate top reinforcement member 35 is supported by the top members 30, and the intermediate side member 38 is supported by the side support members 105. The rear top reinforcement member 35 serves as a connection point for the spring component 135 of the spring pulley 80, through which the spring pulley 80 is routed. The rechargeable battery 110 and the winch mechanism 115 are affixed to the equipment platform 100 in a stable manner through the use of fasteners or the like. A charge controller 140, also mounted to the equipment platform 100, is used to charge the rechargeable battery 110. An incoming power cable 145 brings power to the charge controller 140 from the electrical system of the motor vehicle upon which the device 10 is utilized. The electrical connection is envisioned to be of a temporary nature such as a cigarette lighter. However, a permanent connection may also be utilized. An equipment mounting platform 195 is provided for storage of the rechargeable battery 110, the winch mechanism 115, the charge controller 140, and the in-line fuse 190.

Figure 4:
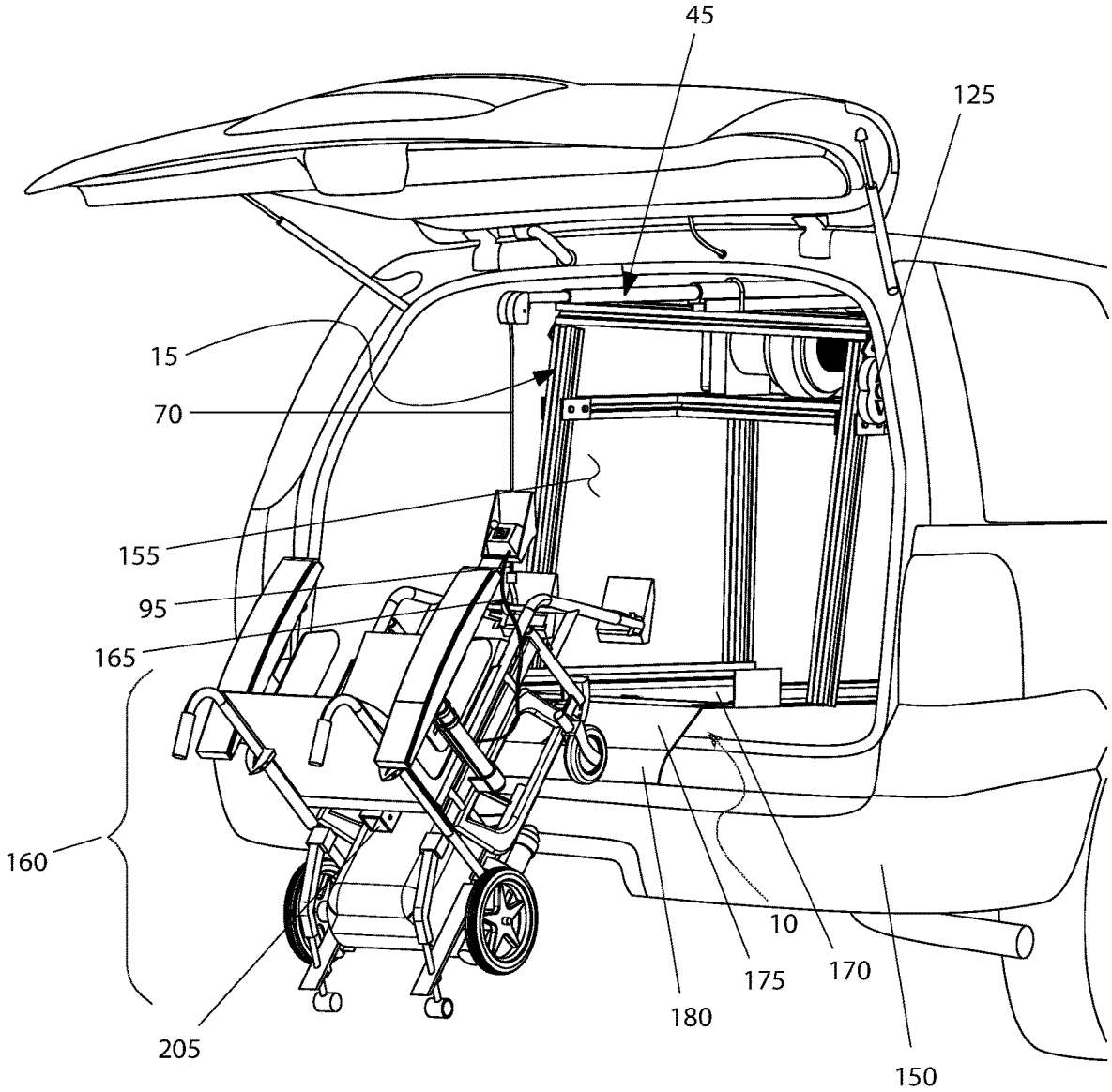
FIG. 4 is a perspective view of the mobility scooter transfer device, shown in a partially utilized state in a motor vehicle, according to the preferred embodiment of the present invention; and, FIG. 5 is a perspective view of the mobility scooter transfer device, shown in a further partially utilized state in a motor vehicle, according to the preferred embodiment of the present invention; and, FIG. 6 is an electrical block diagram of the mobility scooter transfer device, according to the preferred embodiment of the present invention.

Referring now to FIG. 4, a perspective view of the device 10, shown in a partially utilized state in a motor vehicle 150, according to the preferred embodiment of the present invention is disclosed. The motor vehicle 150, herein depicted as a sport utility vehicle (SUV), is provided with a rear cargo area 155 in which the device 10 is installed. The device 10 is mechanically affixed to the interior of the motor vehicle 150 by the use of mechanical fasteners such as rail mounts, floor mounts, tie-downs, direct bolting the vehicle body or frame, or other suitable method. The exact meant of fastening the device 10 to the rear cargo area 155 of the motor vehicle 150 is not intended to be a limiting factor of the present invention. A mobility scooter 160 to be loaded into the rear cargo area 155 is positioned immediately behind the rear cargo area 155 in a central position. To load the mobility scooter 160, the retractable lift arm 45 is extended along the extension/retraction travel path "er" 60 (as shown in FIG. 1) with the flexible lift cable 70 lowered until the lift hook 95 contacts a lift connection point 165 on the mobility scooter 160 that is structurally significant to allow for lifting of the mobility scooter 160. The flexible lift cable 70 is extended and retracted by manipulation of the control switch 125. The front portion of the mobility scooter 160 would be lifted onto the first hinged section 175 and/or the second hinged section 180 as needed. Further details on the lifting process, will be provided herein below.

Figure 5:
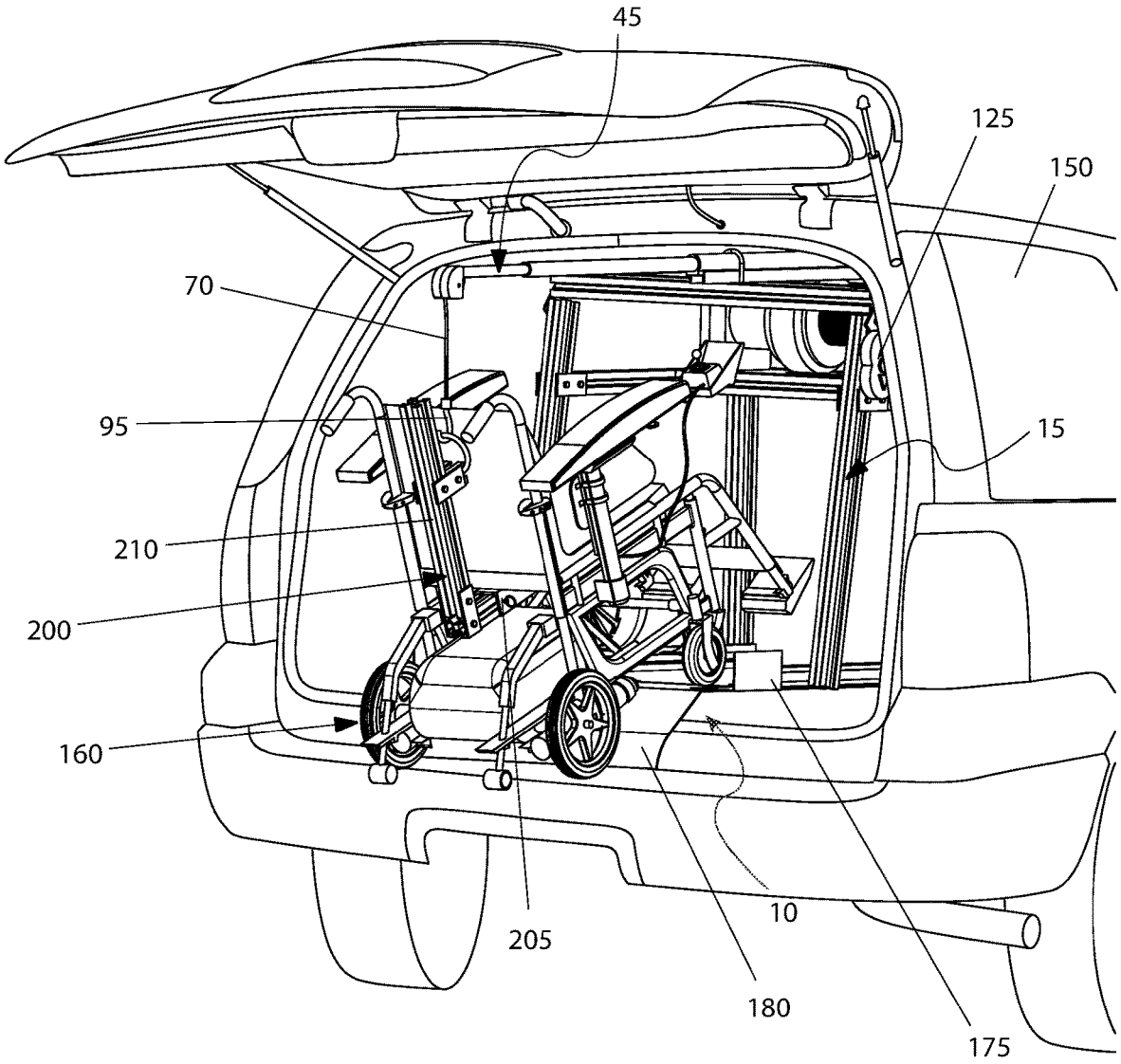

Referring next to FIG. 5, a perspective view of the mobility scooter transfer device 10, shown in a further partially utilized state in a motor vehicle 150, according to the preferred embodiment of the present invention is disclosed. With the mobility scooter 160 resting on the first hinged section 175 and/or the second hinged section 180 (as shown in FIG. 4), the user would release the lift hook 95 and attach it to a "C"-shaped lift aid 200, envisioned to be made of steel. The lower portion of the "C"-shaped lift aid 200 would engage a structurally significant portion of the mobility scooter 160 such as a rear hitch 205. The upper portion of the "C"-shaped lift aid 200 would then engage the lift hook 95. The flexible lift cable 70 is extended and retracted by manipulation of the control switch 125. With the mobility scooter 160 in a horizontal position, it is then rolled onto the base 170, with the aid of a guide handle 210, provided on the upper part of the "C"-shaped lift aid 200. The first hinged section 175, and the second hinged section 180 are then folded along the continuous hinge 185. To lower the mobility scooter 160 out of the rear cargo area 155, this process described in FIG. 5 and then FIG. 4 is then reversed. It is envisioned that the device 10 could be utilized with all makes and models of mobility scooter 160.

Figure 6:
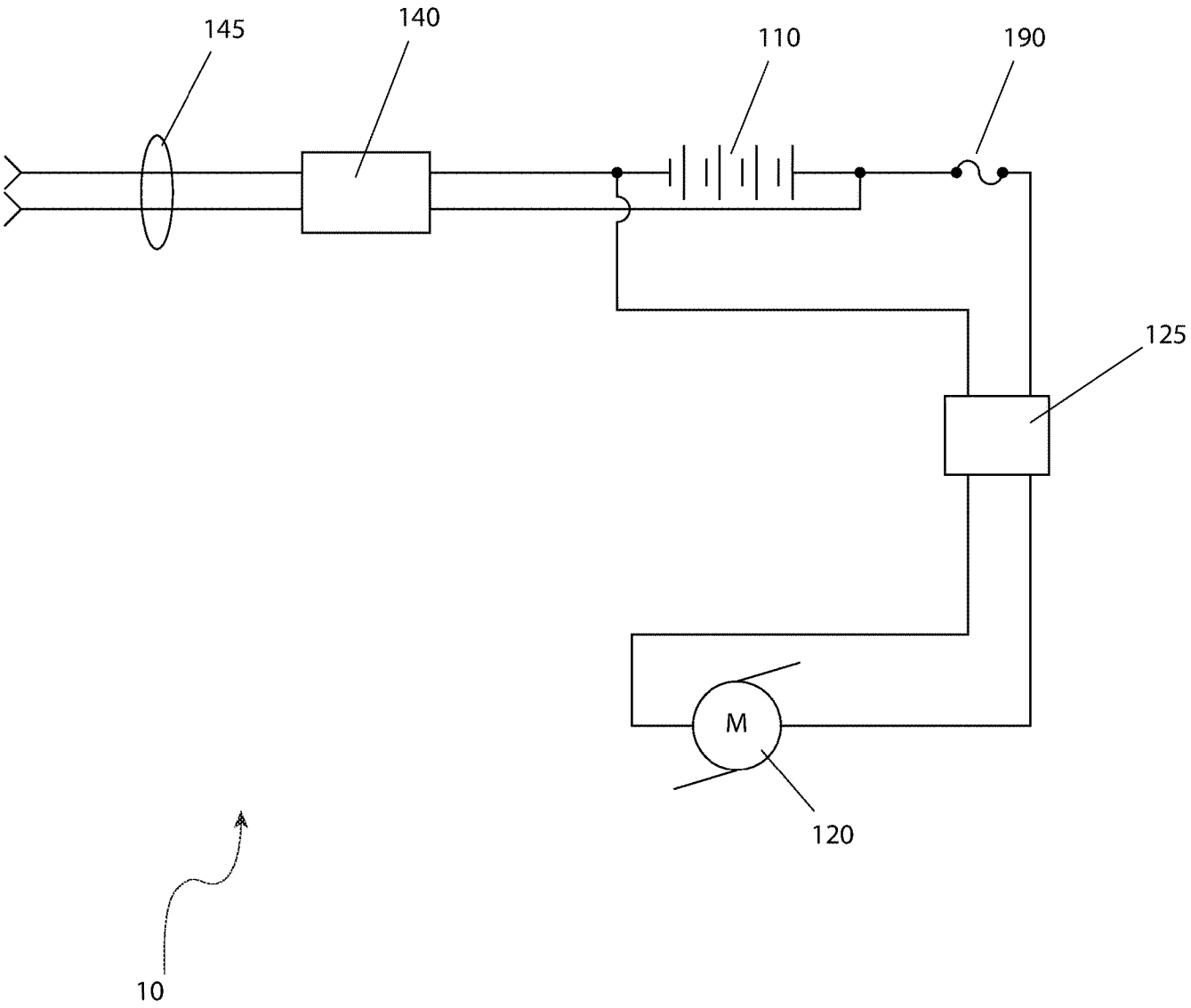

Referring to FIG. 6, an electrical block diagram of the device 10, according to the preferred embodiment of the present invention is depicted. The incoming power cable 145 provides incoming power to the charge controller 140 as aforementioned described. Regulated charging output is then provided to the rechargeable battery 110. The use of the rechargeable battery 110 ensures that the device 10 may be operated without the motor vehicle 150 (as shown in FIG. 4) in a running or energized state. Additionally, the charge controller 140 serves to ensure that any electrical fault on either the device 10 or in the motor vehicle 150 will not affect operation of the remaining device. The electrical output of the rechargeable battery 110 is envisioned as being high current to operate the motor 120 of the winch mechanism 115 (as shown in FIG. 2). The in-line fuse 190 provides overcurrent protection for the rechargeable battery 110. A direct connection to the electrical system of the motor vehicle 150 is likely not able to support such high current loads without elaborate modifications. The resultant power from the rechargeable battery 110 is the routed to the control switch 125 which reverses polarity to the motor 120 allow for rotation in either direction for raising and lowering purposes.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 5. The user would procure the device 10 from conventional procurement channels such as medical supply stores, mail order and internet supply houses and the like. Special attention would be paid to the overall physical size of the device 10 such that it fits within the rear cargo area 155 of the motor vehicle 150 and the mobility scooter 160 fits within the confines of the frame 15.

After procurement and prior to utilization, the device 10 would be prepared in the following manner: the device 10 is installed within the rear cargo area 155 of the respective motor vehicle 150 and secured in place; the incoming power cable 145 is then connected to a suitable source of 12-VDC power from the electrical system of the motor vehicle 150. At this point in time the device 10 is ready for use.

During utilization of the device 10, the following procedure would be initiated: to raise a mobility scooter 160 into the rear cargo area 155, said mobility scooter 160 is positioned immediately behind the rear cargo area 155 in a central position; the retractable lift arm 45 is extended outward from the motor vehicle 150 along the extension/retraction travel path "er" 60; the flexible lift cable 70 is lowered until the lift hook 95 contacts the lift connection point 165; whereupon it is hooked in place; the control switch 125 is then manipulated to raise the flexible lift cable 70 and thus the mobility scooter 160; depending on the specifics of the motor vehicle 150 and the mobility scooter 160, the mobility scooter 160 may be lifted all at once, or the lift may be made in two (2) separate processes by lifting a first portion into the rear cargo area 155, and then lowering the lift hook 95 to lift the remaining portion of the mobility scooter 160 via the "C"-shaped lift aid 200 (as shown in FIG. 5) into the rear cargo area 155; the process of lowering the mobility scooter 160 out of the rear cargo area 155 is accomplished by reversal of the above mentioned process.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A mobility scooter transfer device, comprising:

a frame having a plurality of base members, a plurality of vertical members, a plurality of top members, a plurality of top reinforcement members, a plurality of side support members, and a plurality of side reinforcement members, the base members form a stable structure when connected to the vertical members, which support the side support members, the top members, a front reinforcement members and a rear top reinforcement member, and a rear side reinforcement member and a intermediate top reinforcement member is supported by the top members;

a winch mechanism mounted on an equipment platform attached to the frame, the winch mechanism includes a flexible lift cable routed from a reel through a spring pulley and onto a proximal pulley;

a lift arm support bracket mounted in a perpendicular manner on top of central aligned positions of each of the top reinforcement members;

a retractable lift arm mounted atop the lift arm support bracket using at least one "U"-shaped clamp;

a pulley cover providing a protective cover to the spring pulley and a distal pulley;

a first hinged section connected to the base via a first continuous hinge, the first hinged section serves as a storage platform for a mobility scooter;

a pair of guides located on opposing perimeter edges of the first hinged section adjacent the plurality of base members, the pair of guides extend away perpendicularly therefrom;

a second hinged section connected to the first hinged section by a second continuous hinge;

an equipment platform supporting the side support members and the side reinforcement members;

an in-line fuse provided for electrical protection;

a charge controller mounted to the equipment platform, the charge controller is used to charge a rechargeable battery;

an incoming power cable bringing power to the charge controller from the electrical system of a motor vehicle; and an equipment mounting platform provided for storage of the rechargeable battery, the winch mechanism, the charge controller, and the in-line fuse;

wherein the base, the first hinged section, and the second hinged section serve to house the mobility scooter; and wherein the rechargeable battery and the winch mechanism are affixed to the equipment platform.

2. The mobility scooter transfer device according to claim 1, wherein each of the rear top reinforcement members serve as a connection point for a spring component of the spring pulley, through which the spring pulley is routed.

3. The mobility scooter transfer device according to claim 1, wherein the frame has a trapezoidal prism shape.

4. The mobility scooter transfer device according to claim 1, wherein the flexible lift cable is routed through a hollow interiors of a sequential tubular elements of the retractable lift arm whereupon the flexible lift cable emerges at a distal end of each of the sequential tubular elements and is routed through a distal pulley.

5. The mobility scooter transfer device according to claim 1, wherein a distal end of the flexible lift cable then terminates at a lift hook.

6. The mobility scooter transfer device according to claim 5, wherein the retractable lift arm includes a plurality of sequential tubular elements which slide inside of the neighboring sequential tubular elements allowing the retractable lift arm to retract along an extension/retraction travel path.

7. The mobility scooter transfer device according to claim 1, wherein the retractable lift arm is segmented into a plurality of sections and is locked in an extended position with a plurality of mechanical fixators.

8. The mobility scooter transfer device according to claim 1, wherein the retractable lift arm is segmented into a plurality of sections and is locked in an extended position with a plurality of electrical fixators.

9. The mobility scooter transfer device according to claim 1, wherein the pulley cover is removably attached to the individual pulley.

10. The mobility scooter transfer device according to claim 1, wherein the pulley cover surrounds the individual pulley.

11. The mobility scooter transfer device according to claim 1, wherein the pulley cover is curved to reduce snagging with the motor vehicle.

12. The mobility scooter transfer device according to claim 1, wherein the pair of guides are "L"-shaped and help guide the mobility scooter during ingress and egress on the base.

13. The mobility scooter transfer device according to claim 1, wherein the equipment platform holds a rechargeable battery and the winch mechanism that includes the reel, a motor, and a control switch.

14. The mobility scooter transfer device according to claim 1, wherein the pulley cover is curved to reduce incidental contact with the motor vehicle.

15. The mobility scooter transfer device according to claim 1, wherein the mobility scooter transfer device lifts and lowers the mobility scooter in and out of a cargo area of a motor vehicle.

16. The mobility scooter transfer device according to claim 15, wherein the motor vehicle is a vehicle selected from the group consisting of a sport utility vehicle, a minivan, a pickup truck, a van, or a station wagon.

17. The mobility scooter transfer device according to claim 1, wherein the motor vehicle is provided with a rear cargo area in which the mobility scooter transfer device is installed.

18. The mobility scooter transfer device according to claim 1, wherein the mobility scooter transfer device is made of metal.

19. The mobility scooter transfer device according to claim 18, wherein the mobility scooter transfer device is made of aluminum.

20. The mobility scooter transfer device according to claim 1, wherein the mobility scooter transfer device is 42 ins. wide, 42 ins. deep and 36 ins. tall.

* * * * *